United States Patent [19]

Ichikawa et al.

[11] Patent Number: 4,561,561

[45] Date of Patent: Dec. 31, 1985

[54] CONTAINER HAVING AN EASY OPENING END WITH A TAB AFFIXED BY ULTRASONIC WELDING

[75] Inventors: Masashi Ichikawa; Yasuo Takahashi; Tohru Saito, all of Sagamihara, Japan

[73] Assignee: Nippon Steel Corporation, Japan

[21] Appl. No.: 650,509

[22] Filed: Sep. 14, 1984

[30] Foreign Application Priority Data

Sep. 26, 1983 [JP] Japan ..... 58-176200

[51] Int. Cl.[4] ..... B65D 17/34

[52] U.S. Cl. ..... 220/270; 413/14

[58] Field of Search ..... 220/269–273; 413/14

[56] References Cited

U.S. PATENT DOCUMENTS 3,563,199 2/1971 Wolfe ..... 220/270

*Primary Examiner*—G. T. Hall

*Attorney, Agent, or Firm*—Cushman, Darby & Cushman

[57] ABSTRACT

A container having an EOE with a tab affixed by welding is provided. In the EOE the top wall is made of surface treated steel sheet and the tab is made of stainless steel sheet or tin free steel sheet and the ultrasonic welding is used to fix the tab to the top wall. Through the invention monometallized containers can be supplied easily and cheaply.

5 Claims, 3 Drawing Figures

CONTAINER HAVING AN EASY OPENING END WITH A TAB AFFIXED BY ULTRASONIC WELDING

BACKGROUND OF THE INVENTION

1. Field of the Invention

This invention relates to containers having an easy opening end (hereafter referred to as EOE) which are used as cans for food or for beverage or other fluids.

2. Description of the Prior Art

Heretofore there have been used two kinds of EOE for metal containers, one kind being made of steel and the other of aluminium. In both EOEs a top wall and a tab are fixed by a mechanically caulked structure. The following is a brief description of the prior art method of constructing an EOE.

A top wall the inside surface of which has been coated in advance is scored on its outside surface in a form to be torn off from the top wall. At the center of the top wall is formed a projection having a diameter of 2 to 5 millimeters and a height of 1 to 5 millimeters.

A tab is formed having two holes punched therein. One hole is to enable the forefinger to remove the removable portion of the top wall defined by the scoring. The other hole is for accepting the projection at the center of the top wall.

After the tab is positioned on the projection of the top wall, the projection is crushed, i.e. caulked, fixing the tab on the top wall.

After the fixing of the tab, the inside surface of the top wall, especially around the caulked projection is recoated.

The top wall of such an EOE made of steel or aluminium or paper sheet is utilized for containers which have a side wall made of steel sheet, aluminium sheet, or plastic sheet. Metal containers made of steel or aluminium sheet are generally divided into 2-piece or 3-piece cans according to the purpose, such as what the can is to contain, the material of the container, and the form of the container.

In case of a 2-piece can, a bottom wall and a side wall are formed in one piece. (Hereinafter such a one-piece side and bottom wall is referred to as a "side body".) Such containers are called DI cans (drawn and ironed can), Drawn cans or DRD cans (drawn and redrawn can).

In case of a 3-piece can, the top, bottom and side walls are formed separately and united.

The side wall of a 3-piece can must be bonded along its axis by soldering, adhesively bonding or welding. For 3-piece cans steel sheet is generally used, because aluminium has poor bonding and welding properties.

With regard to steel containers, the top wall with the EOE is made of steel or aluminium for reasons stated hereinbelow, although the side body of 2-piece cans or the side and bottom walls of 3-piece cans are made of various surface treated steel sheets. Because of this fact, the recent social demand for the recycling of resources cannot be satisfied sufficiently.

The application of the conventional EOE made of steel is limited because of its poor easy opening properties. The reason for the limited application is that the properties needed for the top wall, that little strength is needed to tear off the scored part, is at odds with another property needed for the top wall, that it must have the deep drawability required to affix the tab by caulking.

From this point of view aluminium is suitable for the top wall of EOEs because of its low yield strength and high deep-drawability. But it is very difficult for steel sheet to satisfy the said two properties and therefore it has been said that the easy opening properties are inferior to those of aluminium.

In the conventional EOE the recoating is carried out on the inside surface of the top wall to prevent corrosion caused by the contents of the can. But because of the complex structure of the caulked projection, it is difficult to guarantee a perfect coating on the caulked projection, and occasionally corrosion may appear from there.

One proposal is made by the U.S. Pat. No. 3,946,896, which discloses an EOE having a closure in the form of a filmlike tab with a bottom portion which is welded in a closed loop adhesive bond or weld line about an opening. This type of EOE is quite different from that of the present invention. Furthermore the material of the top wall to be used in the prior art is plastic or alumimium and the weld disclosed in the patent is molecular bonding as disclosed by the claim.

SUMMARY OF THE INVENTION

This invention was developed to solve the inconvenience of the conventional EOE for metal containers, especially EOEs made of steel sheet.

As such the object of the present invention is to provide a container with an EOE having i.e. a tab fixed by ultrasonic welding, not by a mechanically caulked structure.

Another object of the invention is to provide a container made only of steel sheet.

Yet another object of the invention is to provide a new method of producing a container having a tab fixed by ultrasonic welding.

The novel features characterizing the invention are set out in the following. The improved container and method will be best understood upon perusal of the following detailed description of the specific embodiment with reference to the accompanying drawings.

DETAILED DESCRIPTION OF THE INVENTION

Figure 1:
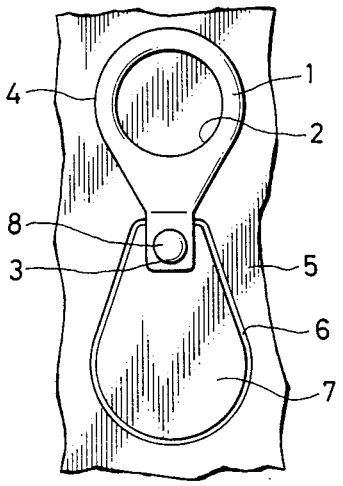
FIG. 1 PRIOR ART
FIG. 1 is a side view of part of a conventional EOE with a tab attached to a removable scored portion.
Figure 2:
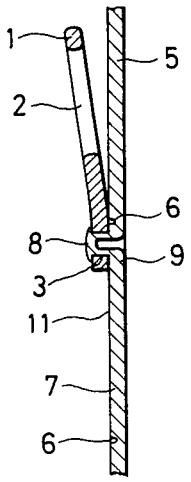
FIG. 2 PRIOR ART
FIG. 2 is a cross-sectional view of the structure shown in FIG. 1.
Figure 3:
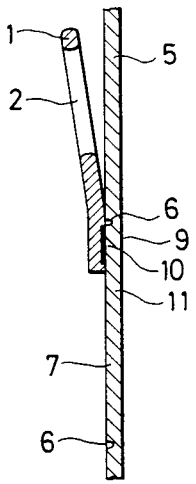
FIG. 3 is a cross-sectional view of the structure according to the present invention.

It is rather easier to produce a steel sheet satisfying the easy opening requirements that is equal or superior to those of aluminium than to develop a steel sheet having the two required properties explained in the above.

The idea that a nonmechanical fixing method is desirable for this purpose developed into the new concept of the invention of constructing the EOE by a welding method.

Through the development of the new method of constructing an EOE by welding, the use of a monometal becomes possible by replacing EOEs made of aluminium by EOEs made of steel, while the difficulties involved in recovery of used containers are also resolved.

Furthermore an increase in the supply of steel containers which are cheaper than aluminium ones becomes possible. The important requirements for steel EOEs are that they are to open and resist corrosion during the storage and display in a shop. There are two kinds of corrosion resistance, one relating to the contents of the container and the other relating to the external portion which is exposed to the air. To prevent corrosion caused by the contents of the container tin plated steel sheet, chromium plated steel, or various alloy plated steel sheet are used. It is preferred that the tab 1 to be fixed on the top wall 5 be made of stainless steel for the corrosion resistance stainless steel provides to the edge of the punched tab 1. Various surface treated steel sheets can be also used for a tab 1 wherein the edge 4 is protected by coating or folding.

The inventors realized that stainless steels, TFS (Tin Free Steel), and chromium plated steel sheet are preferable from the point of weldability as explained hereafter, for such materials have a hard oxide or hydroxide film on their surface.

In the prior art a tab 1 has two openings 2, 3. Through one opening 2 the forefinger may be hooked to tug outwardly on the tab 1 to remove the removable portion 7 defined by the scored line 6 of the top wall. In the other opening 3 is set the projection 8 formed within the scored area 6 of the top wall and affixed by caulking.

Usual welding methods, for example spot welding, are not applicable in place of the caulking, because the zone affected by the heat will extend through the top wall 5 and damage the precoated inside surface 9 of the top wall 5. This damage adversely affects the appearance and the recoating following the welding is difficult. Therefore the welding method to be applied is such that the zone affected by the heat of the method extending through the thickness of the top wall must be extremely small compared with the welded area.

After extensive study of various combinations of steel sheet, welding methods and welding conditions, the inventors found that ultrasonic welding is the most suitable method and provides an appropriate weld.

Ultrasonic welding has been applied to the welding of light metals, such as aluminium and copper, and to plastics, but has been little applied to steel.

It was found that difficulties exist in welding tin plated steel sheet together relating to the increased welding time and the input energy needed. But when one of two sheets to be welded is a stainless steel sheet or a TFS sheet, the welding can be completed in a shorter time and a weld having a smaller heat affected zone can be obtained.

In the case of ultrasonic welding of tin plated steel sheets, the surface layer of tin should be removed at an early stage of the process and the weld point 10 built up between the base steel sheets. But if the tin layer is not removed immediately and it becomes molten, the welding does not proceed because of the resultant decrease in the friction coefficient. For this reason a sound weld of tin plated steel sheets cannot be obtained.

When at least one of the pair to be welded together is stainless steel or TFS, the hard oxide or hydroxide film on the surface is destroyed by ultrasonic vibration, revealing the clean surface of the base metal sheet. It has been clarified that the destroyed film functions as an abrasive against the other surface treated steel sheet, easily removing the plated surface layer.

This mechanism speeds up the welding process and enables it to be accomplished in a short time.

Thus the idea of the invention that a sound weld can be obtained when stainless steel or TFS is used as at least one of a pair of sheets to be welded, and the use of ultrasonic welding, was reached by the inventors.

A sound weld can be also obtained when TFS is used for the top wall 5 to which is to be affixed the tab 1 made of stainless steel or TFS.

In the invention the tab 1 is prepared in the same way as in the prior art, except that it is provided with only one opening 2, for the forefinger. The scoring of the top wall 5 is also the same as in the prior art. According to this invention a tab 1 made of stainless steel or TFS is affixed at an appropriate position on the top wall, as in the prior art.

The ultrasonic welding is performed by an apparatus known in the art. Ultrasonic vibration is applied in a direction parallel with the contacted surfaces. The weld 10 is thus obtained between the tab 1 and the top wall 5.

In the invention various surface treated steel sheets can be used for the top wall of the containers according to the purpose of the containers. When the top wall is made of TFS, the inside surface 9 of it is generally coated to provide corrosion resistance. Also the outside surface 11 must be recoated around the scored portion in order to ensure the corrosion resistance, when the surface treated layer or the plated layer of the top wall is destroyed by the scoring. When the outside surface 11 is recoated with a lacquer, the lacquer coating layer exists between the surfaces of the top wall and the tab to be welded to each other. This lacquer coating does not cause any difficulties in the invention, because it is destroyed at the early stage of the ultrasonic welding process in the area in which the top wall 5 and the tab 1 are contacted. Therefore the strength of the weld is scarcely affected by the lacquer coating. To destroy the lacquer layer, it is enough to control the welding time, i.e. by extending the period of the ultrasonic vibration to slightly longer than in the case of no lacquer layer.

As explained hereabove the new EOE according to the present invention made of steel has a tab 1 made of stainless steel or TFS fixed by ultransonic welding on the top wall 5 made of the surface treated steel sheet. Such an EOE is combined, using known methods, with a side body in case of a 2-piece can or with a side wall in the case of a 3-piece can.

The present invention will now be illustrated by specific examples.

EXAMPLES

The welding apparatus used has an output of 1.2 KW. The pressure and the welding time are 50–100 Kg and 0.1–0.5 sec., respectively. The T-shape tensile test after the manner of opening of a can was used to test the welds. The coated inside surfaces of the welded top walls were inspected to ascertain whether the said surfaces had been affected by the heat. For the samples tin plated steel sheets (ET#25), TFS (chromium plated steel sheet) and ferritic stainless steel sheets (SUS410, AISI410) were used. Various combinations of these three steel sheets as shown in Table I were welded and evaluated. In Table II the results of the tensile test and the inspection are shown. Table II indicates that when the tab is made of stainless steel or TFS, the EOEs welded by the ultrasonic welding process can be put to practical use without, or with a slight, recoating.

TABLE I

| No. | Combination of materials of tab and top wall: Tab | Top wall | Preassure (kg) | Weld time (sec.) |
|---|---|---|---|---|
| 1 | ET#25 | ET#25 | 100 | 0.5 |
| 2 | ET#25 | TFS | 100 | 0.3 |
| 3 | TFS | ET#25 | 100 | 0.2 |
| 4 | TFS | TFS | 75 | 0.1 |
| 5 | Stainless steel | ET#25 | 100 | 0.2 |
| 6 | Stainless steel | TFS | 50 | 0.1 |
| 7 | Stainless* steel | TFS | 50 | 0.2 |

*Outside surface also coated with lacquer before the ultrasonic welding

To evaluate the strength of the welds, 3 to 5 Kg was taken as the standard level strength needed to open an EOE. The welds marked O in Table II had a strength of 20 Kg or more, Δ 10 Kg or more but less than 20 Kg, and X below 10 Kg. In evaluating the coating on the inside surface, the welds whose coating showed no change are marked O, ones which showed a slight change but were repairable are marked Δ, and ones which are unrepairable are marked X.

TABLE II

| No. | Combination of materials of tab and top wall: Tab | Top wall | Strength of weld | Heat effect of coating |
|---|---|---|---|---|
| 1 | ET#25 | ET#25 | X | X |
| 2 | ET#25 | TFS | Δ | X |
| 3 | TFS | ET#25 | O | Δ |
| 4 | TFS | TFS | O | O |
| 5 | Stainless steel | ET#25 | O | Δ |
| 6 | Stainless steel | TFS | O | O |
| 7 | Stainless* steel | TFS | O | O |

*Outside surface also coated with lacquer before the ultrasonic welding

In Example No. 7 the top wall was coated with lacquer on its outside surface, which corresponds to the external surface of the container, before the welding. As shown in Table II the weld had sufficient strength and the coating on its inside surface was not heat-affected.

From this test result the lacquer coating on the outside surface of the top wall scarcely influences the weldability between the tab and the top wall. It is enough to prolong the welding time by about 0.1 sec. to remove the lacquer layer existing between the surface of the top wall and the tab.

As stated hereabove according to the invention an EOE which is little influenced by heat and has sufficient strength of weld can be obtained by ultrasonic welding of a tab made of stainless steel or TFS sheet to a top wall made of a surface treated steel sheet.

This invention enables the conventional caulking process to be avoided and damage to the coating on the inside surface of the top wall to be remarkably reduced, thereby reducing the amount of recoating required. Through these advantages of the invention it is possible to produce containers in which there is no possibility of corrosion occurring caused by hollows arising during the recoating process.

The commercial merit of this invention lies in its simplification of the production process, the inexpensiveness of the materials and the monometalizing of the containers.

What is claimed is:

1. A container having a top wall made of a surface-treated steel sheet, and a tab made of stainless steel sheet or tin-free steel sheet ultrasonically welded to said top wall.

2. A container in accordance with claim 1 wherein a side wall and a bottom wall of the said container are made of surface treated steel sheets.

3. A method of producing a container comprising the following steps:

(a) scoring in a predetermined form a top wall made of a surface treated steel sheet, (b) fixing a tab made of stainless steel sheet or tin free steel sheet within the scored portion of the top wall by ultrasonic welding, (c) combining the said top wall having the tab with a side body in the case of 2-piece can or with a side wall combined with a bottom wall in the case of 3-piece can.

4. A method of producing a container in accordance with claim 3 which further comprises the following step:

(d) coating the outside surface of the top wall with lacquer after the top wall has been scored.

5. A method of producing a container in accordance with claim 3, which further comprises the following step:

(e) recoating the inside surface of the top wall after the fixing of the tab to the top wall.

* * * * *